United States Patent [19]

Suzuki et al.

[11] 4,295,499

[45] Oct. 20, 1981

[54] DETECTION OF WEFT IN SHUTTLELESS LOOM

[75] Inventors: Hajime Suzuki, Anjyo; Yoshimi Iwano, Ohbu, both of Japan

[73] Assignee: Kabushiki Kaisha Toyoda Jidoshokki Seisakusho, Kariya, Japan

[21] Appl. No.: 100,408

[22] Filed: Dec. 5, 1979

[30] Foreign Application Priority Data

Dec. 12, 1978 [JP] Japan ..... 53-152671
Dec. 12, 1978 [JP] Japan ..... 53-169878
Dec. 12, 1978 [JP] Japan ..... 53-169879

[51] Int. Cl.[3] ..... D03D 51/34
[52] U.S. Cl. ..... 139/370.2; 356/429
[58] Field of Search ..... 139/336, 435, 370.1, 139/370.2; 356/199, 200

[56] References Cited

U.S. PATENT DOCUMENTS 3,853,408 12/1974 Kaalverink ..... 139/370.2 X
3,978,893 9/1976 Inagawa et al. ..... 139/370.2
4,085,777 4/1978 Dadak et al. ..... 139/370.2
4,150,699 4/1979 Suekane ..... 139/370.2

FOREIGN PATENT DOCUMENTS 2105559 8/1972 Fed. Rep. of Germany ... 139/370.2
1236341 6/1971 United Kingdom ..... 139/370.2

*Primary Examiner*—Henry Jaudon
*Attorney, Agent, or Firm*—Wenderoth, Lind & Ponack

[57] ABSTRACT

A shuttleless loom incorporating a weft detecting device according to this invention includes a reed, and a number of guide plates arranged in spaced relationship along the reed, the guide plates being provided with aligned apertures to form a guide passage through which a weft is passed when it is inserted into a shed of warps. In order to detect whether or not the weft has been inserted into the shed, the weft detection device is provided with a photoelectric detecting unit disposed between the adjacent guide plates so as to be movable therewith. The detecting unit emits and receives a light beam advancing along a path which extends between the adjacent guide plates and across a path of the weft along which it moves relative to the guide plates after it has been passed through the guide passage.

8 Claims, 6 Drawing Figures

DETECTION OF WEFT IN SHUTTLELESS LOOM

BACKGROUND OF THE INVENTION

This invention relates to a weaving loom, and more particularly to the detection of weft in a shuttleless loom.

Various weft detecting devices have been provided to detect whether or not a weft inserting apparatus has favorably completed its function of weft inserting for each of the weft yarns in a shuttleless loom, for example, such as an air-jet loom.

Also, an air-jet loom has been known in which a notch is formed in each of dents wherein is found a reed so that a weft guide passage is provided in the reed. To detect weft inserted through the guide passage formed in the reed, it has been known to mount a weft detecting device on the reed at a position between a cloth selvage and a waste selvage, such device including a photoelectric detection unit emitting and receiving a light beam passing across the weft guide passage. This device is disposed so as to ride on the dent or dents, which is or are within a region subject to substantial influence of an air-jet stream injected from an air-jet nozzle closely adjacent to the cloth selvage, thereby causing vibrations of a portion of the inserted weft present in the dent or dents, on which the device rides, to facilitate detection of the weft by means of the detection unit.

However, such a weft detecting device would not be favorably applicable to an air-jet loom, such as those shown in U.S. Pat. Nos. 4,085,777 and 4,150,699, wherein a weft is inserted through a guide passage provided in a series of guide plates located in front of a reed. This air-jet loom requires removal of the inserted weft from the guide passage, while the afore-mentioned type of air-jet loom, wherein the weft is inserted through the guide passage formed in the reed itself, does not require the weft to be removed from the guide passage, since the weft beating is carried out with the weft maintained at a fixed position in the guide passage.

Furthermore, German Pat. No. 2,105,559 and U.S. Pat. Nos. 4,085,777 and 4,150,699 each disclose a weft detection device applied to an air-jet loom of the aforementioned type, wherein the weft is inserted through the guide passage, formed in the guide plates, and then removed therefrom. Each of these detection devices has a detection unit incorporated in the guide plate itself so as to allow a light beam emitted by the detection unit to pass across the narrow exit slot defined by the associated guide plate. It will be therefore understood that these known devices are adversely affected by vibrations of the guide plate in which they are incorporated and a number of guide plates each incorporating the detection unit must be provided to allow for changes in the width of a cloth. Furthermore, it is required that each guide plate with the detection unit be of a relatively great thickness to have the detection unit incorporated therein, possibly causing additional disadvantages.

SUMMARY OF THE INVENTION

It is therefore a principal object of this invention to provide a device for detecting a weft in a shuttleless loom, which can eliminate all the afore-mentioned disadvantages.

In general, a shuttleless loom incorporating a weft detection device according to the present invention includes a reed, and a number of guide plates arranged in spaced relationship along the reed, the guide plates being provided with aligned apertures to form a guide passage through which a weft is passed when it is inserted into a shed of warps. In order to detect whether or not the weft has been inserted into the shed, the weft detection device is provided with a photoelectric detecting unit disposed between the adjacennt guide plates so as to be movable therewith. The detecting unit emits and receives a light beam advancing along a path, which extends between the adjacent guide plates and across a path of the weft along which it moves relative to the guide plates, after it has been passed through the guide passage.

BRIEF DESCRIPTION OF THE DRAWINGS

This invention will become readily apparent from the following description of a preferred embodiment thereof shown, by way of example only, in the accompanying drawings, in which.

DESCRIPTION OF THE PREFERRED EMBODIMENT

Figure 1:
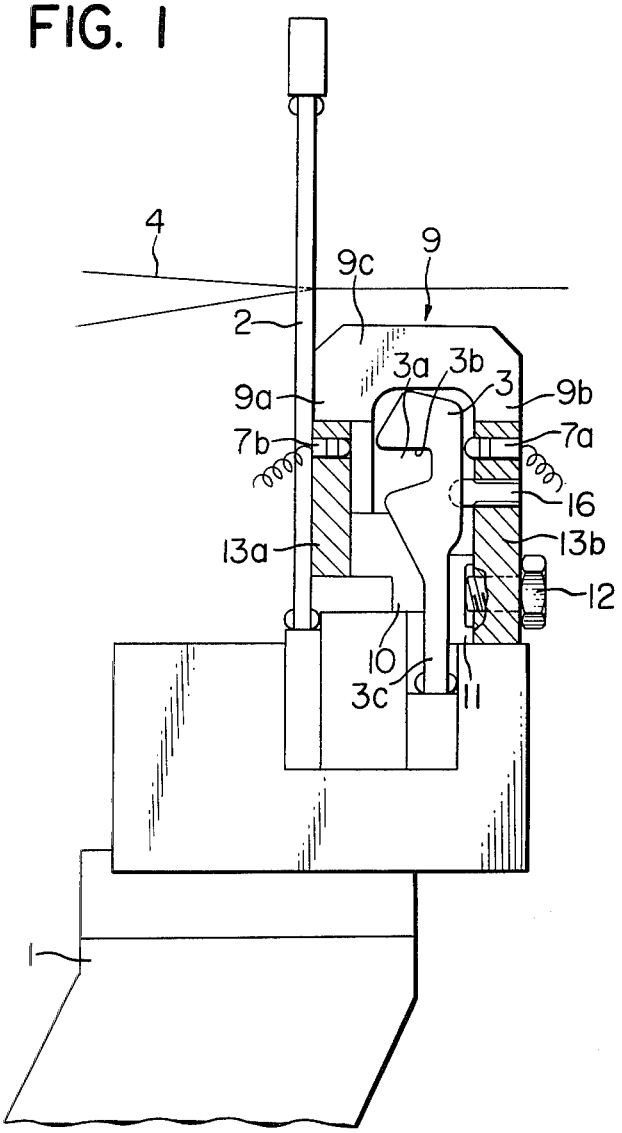
FIG. 1 is a side elevational view showing, partly in section, a weft inserting apparatus including a weft detecting device constructed in accordance with this invention.
Figure 2:
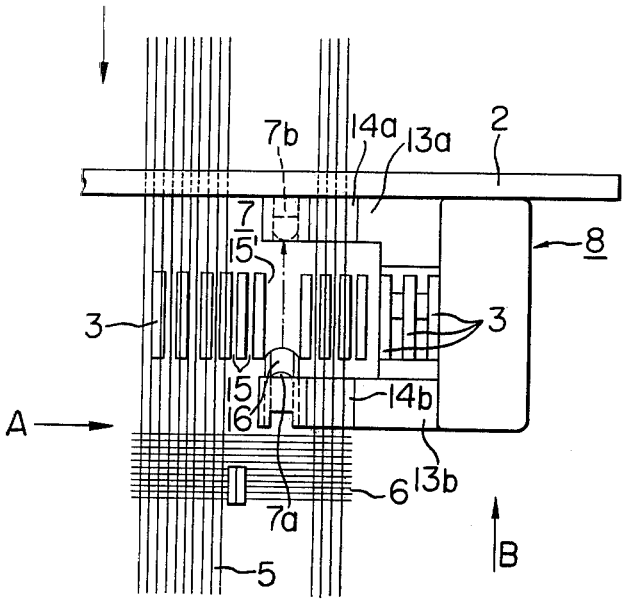
FIG. 2 is a plan view of the weft detecting device of FIG. 1 mounted on the weft inserting apparatus.

Referring to the drawings and particularly to FIGS. 1 and 2, there is shown a weft inserting apparatus provided with a weft detecting device according to this invention. The weft inserting apparatus comprises a slay 1 mounted for pivotal movement toward and away from a cloth fell in a manner which is well known in the art. In FIG. 1, this apparatus is shown on the side of the cloth fell. The slay 1 comprises a reed 2 upstanding therefrom and consisting of a number of known dents, and a series of guide plates or members 3 disposed adjacent to and along the reed 2 with aligned apertures or notches 3*a*, which form a weft guide passage.

Although each notch 3*a* in this embodiment is provided in the side of the respective guide plate 3 facing the reed 2, it may be formed in the side of the respective guide plate remote from the reed 2.

Although not shown, a suitable number of auxiliary jet nozzles as well as means for supplying a fluid, such as pressure air, thereto may be fixedly mounted in position on the slay 1 to assist in inserting the weft through the guide passage.

On one hand, when the slay 1 is turned leftwards in FIG. 1, the notch 3*a*, generally provided in the upper portion of each guide plate 3, enters the shed formed between upper and lower warps 4 to guide the weft as it passes therethrough. On the other hand, each guide plate 3 is moved out of the shed so as to enable the reed 2 to carry out the beating when the slay 1 is turned rightwards into the position shown in FIG. 1. Also, each notch 3*a* is so shaped that prior to the beating, the weft inserted into the shed can be relieved from each notch 3*a* and then can pass through a space between the reed 2 and the outermost end of an upper wall 3*b* defining the notch 3*a* upon displacement of the guide plates 3 to their predetermined position below the shed in harmony with the upward movement of the lower warps. When the slay 1 is turned clockwise toward the position shown in FIG. 1, each notch 3*a* comes out of the shed. At that time, the notch 3*a* causes the weft to go out thereof while contacting with the upper wall surface 3*b* of the notch 3*a*. However, when the weft is passed through the notches along a path adjacent to the weft exit openings of the notches, the weft may go out of the notches without contacting the upper wall surfaces 3*b* thereof, although such a case is rather unusual. In all cases, the front surface of the reed 2 on the side of the cloth fell moves toward the weft relieved from the notches 3*a* and carries out the beating of the weft.

In order to detect whether or not the weft inserting by the afore-mentioned weft inserting operation apparatus has been completed as desired, a weft detecting device 8 is mounted on the slay 1 so as to move therewith with its weft detecting unit 7 positioned between the cloth selvage 5 and the waste selvage 6 as shown in FIG. 2.

Figure 3:
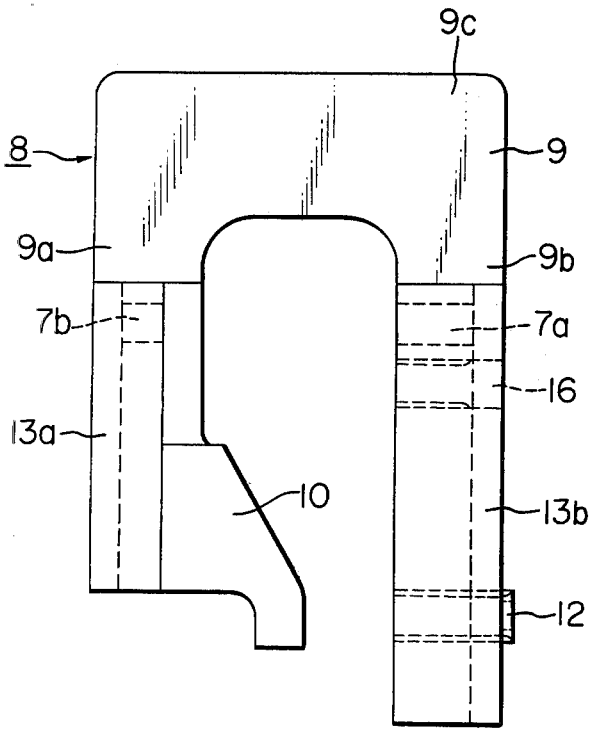
FIG. 3 is a side elevation showing, on an enlarged scale, the weft detecting device as viewed from the left in FIG. 2 as illustrated by an arrow A therein.
Figure 4:
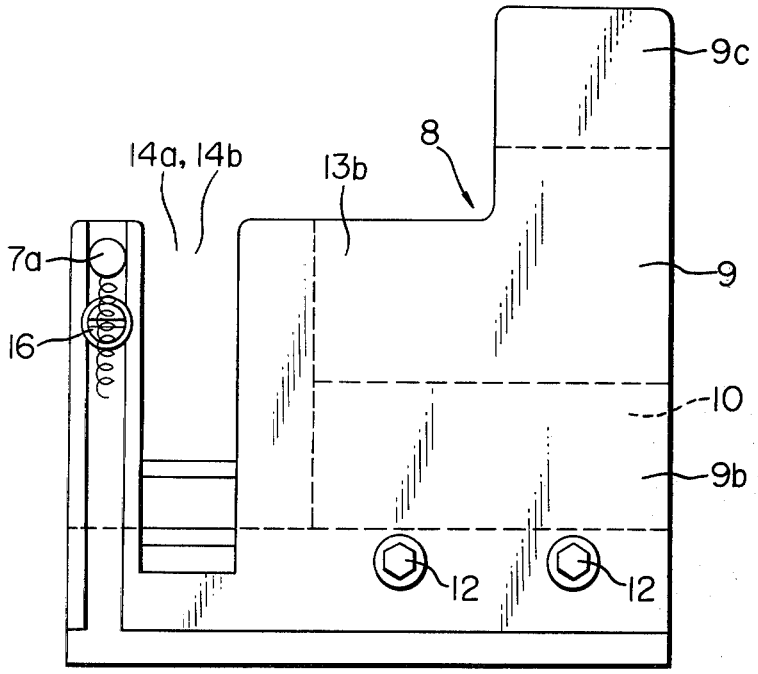
FIG. 4 is a side elevation showing, on an enlarged scale, the weft detecting device as viewed from the bottom in FIG. 2 as illustrated by an arrow B therein.
Figure 5:
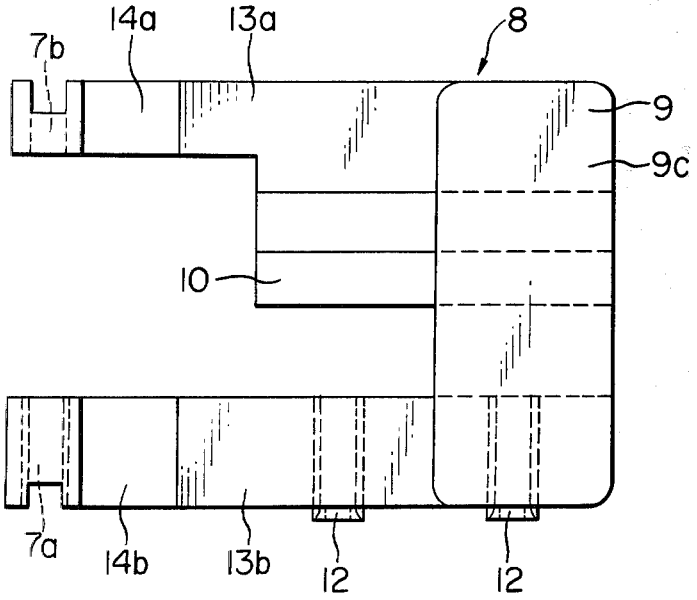
FIG. 5 is a plan view showing the weft detecting device on an enlarged scale.

The details of the weft detecting device 8 are shown in FIGS. 3 to 5. The detecting device 8 includes a mounting member or portion 9 formed into a substantially reversed U-shape and positioned over the guide plates 3 present outside of the waste selvage 6 (FIG. 2). Leg parts 9*a* and 9*b* of the U extend downwardly so as to contain the guide plates 3 present outside of the waste selvage as best shown in FIG. 1. The mounting of the weft detecting device 8 on the slay 1 can be effected by placing a spacer plate 11 between the leg part 9*b* and the guide plates 3 outside of the waste selvage 6 and then forcing the spacer 11 against the leg portion 3*c* of guide plate 3 by means of, for example, screws 12 extending through the leg part 9*b*. On the other hand, there is a supporting part 10 of the mounting portion 9 between the leg part 9*a* and guide plates 3 to laterally support the guide plates 3. Such an arrangement allows the weft detecting device 8 to be mounted fixedly with respect to the leg portions 3*c* of the guide plates and the slay accordingly, which leg portions are thus subject to much less vibration. Therefore, any error in a weft inserting, which would possibly occur if the detecting device were vibrated, can be avoided.

Both the supporting part 10 and the spacer 11 have a sufficient length in the direction of weft insertion to tightly engage a suitable number of guide plates 3 outside of the waste selvage 6. When it is desired to change the width of the cloth, the weft detecting device 8 can be easily moved along the reed and located at a desired position by merely loosening the screws 12.

Preferably, the leg parts 9*a* and 9*b* are formed in one piece by connecting them together by the base 9*c* of the U. However, the base 9*c* may be omitted. In such a case, it is desirable that the leg part 9*a* and the supporting part 10 are formed in such dimensional relationship as to allow the leg part 9*b* to be forced against the reed 2 when the screws 12 are fastened.

Furthermore, the leg parts 9*a* and 9*b* have extensions 13*a* and 13*b* extending toward the cloth selvage 5. In order to prevent interference of the extensions 13*a* and 13*b* with the waste selvage 6 when each guide plate 3 is seated in its operative position or weft inserting position, slots 14*a* and 14*b* each having a predetermined depth and width are provided respectively in the extensions 13*a* and 13*b* so as to receive the waste selvage 6 therein (FIG. 2).

At the innermost ends of the extensions 13*a* and 13*b*, a photoelectric weft detection unit 7 is incorporated. The detection unit 7 is positioned between the cloth selvage 5 and the waste selvage 6 and comprises a light transmitter 7*a* and a light receiver 7*b*, i.e., a photocell disposed on the opposite sides of the guide plate 3.

Both the light transmitter 7*a* and the light receiver 7*b* may be built in one of the extensions. In this case, a light reflecting member should be provided in the other extension.

Figure 6:
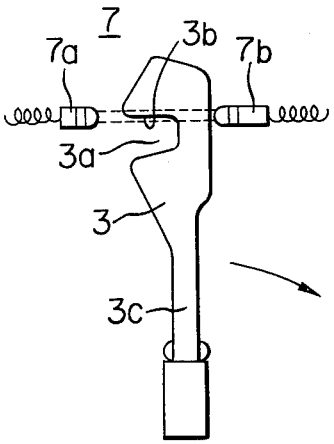
FIG. 6 is a view illustrating the path of a beam of light for weft detection.

A light signal or beam transmitted from the light transmitter 7*a* to the light receiver 7*b* passes along a path, which extends between adjacent guide plates 3 as shown by the broken line in FIG. 2 and which is preferably positioned at a level substantially corresponding to that of the upper wall surface 3*b* of each guide plate 3, as shown by the dotted lines in FIG. 6. As above described, when the notches 3*a* are in the shed defined by the upper and lower warps, the weft is inserted through the guide passage formed by these notches into a path, whose position in the guide passage generally changes with every weft inserting operation. Thereafter, each guide plate 3 is turned in the direction shown by the arrow in FIG. 6, together with the slay 1, whereupon each notch 3*a* is moved out of the shed. At that time, the weft passed through the notches 3*a* of the guide plates is allowed to go out of the notches 3*a* while sliding on the upper wall surface 3*b* of each notch toward the outermost end thereof. Since the light transmitter 7*a* and receiver 7*b* are so positioned with respect to the vertical direction that the path of the light signal is at a level substantially corresponding to that of the upper wall surface 3*b*, the weft always passes across the light beam if it has been inserted through the notches 3*a*. Thus, the weft detection device 8 can detect whether or not the weft inserting operation has been completed.

Although, in FIG. 6, the path of the light beam is at the level substantially corresponding to the height of the notch upper wall surface, its level is not limited thereto. It is essential for this invention that the light beam is adapted to pass across a path of the weft which is traced by the weft until the beating after it has been passed through the guide passage. For example, the light beam may pass across the weft path at a position, such as above the upper wall surface 3*b* of the aperture, or flush with the uppermost end of the upper wall surface of the aperture. The embodiment shown in FIG. 6 assures early positive detection of the weft, since the weft can be detected while it is made to slide on the aperture's upper wall surface, i.e., before it goes out of the aperture. Also, in the case where the light beam is adapted to cross a line connecting the outermost ends of the upper wall surfaces of the adjacent apertures, positive detection of the weft can be assured because the weft is still under control of the upper wall surface of aperture.

Furthermore, as above described, the light beam emitted by the weft detection unit 7 must advance through a space 15 (FIG. 2) between the adjacent guide plates. However, since this space 15 is relatively narrow to assure that the guide passage defined by the apertures of the guide plates can exhibit a good function of guiding the weft, it may be necessary to design the weft detection device 8 to be capable of allowing the light beam from the light transmitter *7a* to reach the light receiver *7b* without being subject to unfavorable influences by the adjacent guide plates between which the light beam advances. For this purpose, means 16 for pushing the adjacent guide plates apart is provided in the extension 13*b* of the weft detection device 8 to increase the width of the space as shown at 15' in FIG. 2. For example, the pushing means 16 comprises an adjustable screw or bolt disposed in line with the light transmitter *7a*. The pushing means 16 may be formed into a wedge-like shape.

Also furthermore, while the illustrated embodiment has been described with reference to one mode of operation wherein the weft passed through the apertures moves toward the weft exit opening while contacting with the upper wall surface of each aperture, it is to be noted that there is a case, although rare, where the weft is inserted along a path adjacent to the weft exit opening of the guide passage. In this case, the weft may go out of the guide passage without contacting the upper wall surface of each aperture. However, according to this invention, since the light transmitter and receiver of the weft detecting unit are so positioned that the light beam emitted by the transmitter positively passes across the path of the weft along which the weft moves relative to the guide passage after it has been passed through the guide passage, the weft detecting unit can detect the weft even in the afore-mentioned case.

For the purpose of explaining this invention in detail, the foregoing description has been made in conjunction with a single embodiment thereof. Therefore, it is to be understood that numerous changes in design may be resorted to within the spirit and scope of the invention. For example, this invention is also applicable to various types of shuttleless looms, such as a gripper type and a rapier type, in addition to an air-jet type.

What we claim is:

1. A shuttleless loom comprising:

a reed;

a plurality of guide plates arranged in spaced relationship along said reed, said guide plates having aligned apertures forming a weft guide passage through which a weft thread is passed, said apertures of said guide plates including upper wall surfaces aligned in a plane;

slay means supporting said reed and said guide plates and mounted for pivotal movement for moving said guide plates from an operative position, whereat said guide plates are within a shed of warp threads and a weft thread is inserted through said guide passage, to an inoperative position outside of the shed, for thereby causing the weft thread to slide in a path realtive to said guide plates along said upper wall surfaces until the weft thread leaves said guide passage and remains in the shed when said guide plates are moved to said inoperative position, and for allowing beating by said reed; and means for detecting whether or not the weft thread has been inserted properly through said guide passage when said guide plates are in said operative position thereof, said detecting means comprising a detecting unit including a mounting member mounted on said slay means for movement therewith and with said guide plates, light transmitter means, mounted on said mounting member on a first side of said guide plates, for emitting a single light beam through a space between two adjacent said guide plates along a path in or above said plane of said aligned upper wall surfaces of said apertures in said guide plates, such that during movement of said guide plates from said operative position to said inoperative position said light beam intersects said path of the weft thread when the weft thread leaves said guide passage and when the weft thread is properly inserted through said guide passage, and light receiver means, mounted on said mounting member on a second side, opposite said first side, of said guide plates, for receiving said single light beam from said light transmitter means.

2. A shuttleless loom as set forth in claim 1, wherein said path of said light beam crosses said path of the weft thread at a position above said plane of said aligned upper wall surfaces of said apertures.

3. A shuttleless loom as set forth in claim 1, wherein said path of said light beam crosses a line connecting the outermost ends of said upper wall surfaces of said apertures in said adjacent guide plates.

4. A shuttleless loom as set forth in claim 1, wherein said path of said light beam is in said plane which includes said aligned upper wall surfaces of said apertures in said adjacent guide plates.

5. A shuttleless loom as set forth in any one of claims 1 to 4, wherein said detecting means further comprises means for adjusting the relative position of said detecting unit with respect to said guide plates in the direction of the weft thread.

6. A shuttleless loom as set forth in any one of claims 1 to 4, wherein said detecting means further comprises means for pushing said adjacent guide plates apart to provide a widened said space between said adjacent guide plates.

7. A shuttleless loom as set forth in claim 5, wherein said mounting member comprises a reverse U-shaped portion disposed over a portion of said guide plates and having a pair of leg parts placing therebetween legs of some of said guide plates, and said adjusting means includes screw or bolt means extending through one of said leg parts for fastening said reverse U-shaped portion to said legs of some of said guide plates.

8. A shuttleless loom as set forth in claim 7, wherein said leg parts have extensions in which said light transmitter means and said light receiver receiver are disposed, said extensions being provided with slots of predetermined dimensions to receive a waste selvage when said guide plates are in said operative position.

* * * * *